US007696454B2

(12) United States Patent
Nam et al.

(10) Patent No.: US 7,696,454 B2
(45) Date of Patent: Apr. 13, 2010

(54) COOKING APPARATUS AND CONTROL METHOD OF THE SAME

(75) Inventors: Hyeun Sik Nam, Seoul (KR); Young Sok Nam, Seoul (KR); Seong Ho Cho, Seoul (KR); Kyung Ah Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 460 days.

(21) Appl. No.: 11/737,342

(22) Filed: Apr. 19, 2007

(65) Prior Publication Data

US 2007/0246453 A1 Oct. 25, 2007

(30) Foreign Application Priority Data

Apr. 20, 2006 (KR) ..... 10-2006-0035764

(51) Int. Cl.

| | |
|---|---|
| ***A21B 3/00*** | (2006.01) |
| ***A21B 3/10*** | (2006.01) |
| ***F24C 7/08*** | (2006.01) |
| ***F24C 15/00*** | (2006.01) |

(52) U.S. Cl. ..... 219/393; 219/411; 219/506; 99/341

(58) Field of Classification Search ..... None
See application file for complete search history.

(56) References Cited

U.S. PATENT DOCUMENTS

| | | | | |
|---|---|---|---|---|
| 3,021,386 | A * | 2/1962 | Clark | 348/83 |
| 6,559,882 | B1 * | 5/2003 | Kerchner | 348/61 |
| 7,532,749 | B2 * | 5/2009 | Watanabe et al. | 382/145 |
| 2006/0260603 | A1 * | 11/2006 | Shah | 126/41 R |
| 2007/0125761 | A1 | 6/2007 | Nam et al. | |
| 2007/0131670 | A1 | 6/2007 | Nam et al. | |

FOREIGN PATENT DOCUMENTS

| | | | |
|---|---|---|---|
| FR | 2880411 | A1 * | 7/2006 |
| JP | 58 224233 | | 12/1983 |
| JP | 09229373 | A * | 9/1997 |
| JP | 11 54265 | | 2/1999 |
| JP | 11054265 | A * | 2/1999 |
| KR | 1991 0006273 | | 8/1991 |

OTHER PUBLICATIONS

English language Abstract of JP 58-224233.
English language Abstract of corresponding KR 10-1985-0005595.
English language Abstract of JP 11-54265.

* cited by examiner

*Primary Examiner*—Joseph M Pelham
(74) *Attorney, Agent, or Firm*—McKenna Long & Aldridge LLP

(57) ABSTRACT

A cooking apparatus is provided having an apparatus body including a burner which heats an object. There may be a first image acquirer provided at one side of the apparatus body, the first image acquirer may be configured to acquire image information corresponding to a heat source generated by the burner. Additionally, a display may be provided at one side of the apparatus body to display the image information acquired by the first image acquirer.

15 Claims, 5 Drawing Sheets

COOKING APPARATUS AND CONTROL METHOD OF THE SAME

CROSS-REFERENCE TO RELATED APPLICATION

This application claims the benefit of Korean Patent Application No. 10-2006-0035764, filed on Apr. 20, 2006, which is hereby incorporated by reference in its entirety.

BACKGROUND OF THE INVENTION

1. Field of the Invention

The present invention relates to a cooking apparatus, and more particularly, to a cooking apparatus constructed in a structure to improve user convenience.

2. Discussion of the Related Art

Various kinds of products, such as a microwave oven and an oven, have been used as cooking apparatuses. The microwave oven is a kind of cooking apparatus which cooks food using only a magnetron or jointly a magnetron and a heater. The oven is another kind of cooking apparatus to heat hermetically sealed food such that the food is cooked by dry heat. Electricity or gaseous fuel is used as an energy source to supply heat to the food.

The oven includes an oven unit to cook food using high-temperature heat in a hermetically sealed space and a cooktop unit to cook food in a direct heating fashion.

The oven unit cooks bulky food using convective heat and radiant heat. In the oven unit is mounted a heater to heat food. The heater may be used to bake bread or cake. Also, infrared rays may be irradiated to broil fish. On the other hand, the cooktop unit cooks food using radiant heat transmitted from burners mounted above the oven unit and conductive heat transmitted from a container to the food.

However, the conventional cooking apparatus has the following problems.

First, when an object to the heated is placed on the cooktop unit to cook food, it is required that a user bend his/her back to check the state of flames so as to control the amount of heat applied to the object according to the state of the food.

Second, it is required that the user open a door of the oven unit to check the state of food or look in the oven unit from the outside of the door with the naked eye so as to check the cooked state of the food which is being cooked in the oven unit.

When the user opens the door of the oven unit so as to check the cooked state of the food, heat in the oven unit is directly transmitted to the user with the result that the user may get burnt. Also, the leakage of heat results in the loss of energy. On the other hand, when the user checks the cooked state of the food from the outside of the door without opening the door of the oven unit, it is difficult for the user to accurately check the cooked state of the food.

SUMMARY OF THE INVENTION

In one non-limiting embodiment, the cooking apparatus may include an apparatus body having a burner which heats an object. Further, a first image acquirer may be provided at one side of the apparatus body, and the first image acquirer may be configured to acquire image information corresponding to a heat source generated by the burner. Additionally, a display may be provided at one side of the apparatus body to display the image information acquired by the first image acquirer.

In an additional feature, the first image acquirer may be configured to acquire the image information corresponding to a state of the heat source provided between the object and the burner.

In yet still another feature, the display may be provided on at least one of a rear guide provided at the rear of the apparatus body and protruding upwardly therefrom, a burner housing which houses the burner, and a door which opens and closes a cooking chamber of the apparatus body.

In an additional feature, the oven may be provided having a cooking space to cook food. The oven may be mounted below the burner. Additionally, there may be a second image acquirer configured to acquire image information corresponding to a cooked state of the food contained in the cooking space. Further, the display may selectively display the image information acquired by the first image acquirer and the second image acquirer.

In an additional feature, the cooking apparatus may include a controller to process the image information acquired by either one of the first image acquirer and the second image acquirer. In this regard, the image information may be displayed on the display in a user selected form.

According to another feature, a protection cover which protects either one of the first image acquirer and the second image acquirer may be provided. Further, a driver configured to open and close the protection cover may also be provided.

In an additional feature, the cooking apparatus may include at least one reflector provided between either one of the first and second image acquirers and the object. Further, the at least one reflector may be configured to transmit information about either one of the heat source and the food contained in the cooking space to either one of the first and second image acquirers.

In yet still another feature, a first duct having either one of the first and second image acquirers may be provided at a first end thereof and the reflector provided at a second end thereof. Additionally, a second duct having a first end connected to the first duct at a predetermined angle and a second end facing the object may also be provided.

Additionally, a transparent window may be provided at the second end of the second duct to block the direct transmission of heat to either one of the first and second image acquirers.

In an additional feature, the cooking apparatus may include a cooler which prevents either one of the first and second image acquirers from being damaged due to heat of the cooking apparatus.

Further, in an additional feature, the image information acquired may be an image profile of the heat source. Additionally, the heat source may be flames or any other suitable heating source, e.g., electric.

In additional features of the cooking apparatus, the photographing angle of the first image acquirer may be adjustable, the second image acquirer may be movably mounted inside of the oven compartment, and the first and second image acquirers may be charge-coupled devices (CCDs) camera.

In another non-limiting embodiment, a cooking apparatus including an oven compartment having a cooking space to cook food contained therein may be provided. Additionally, an image acquirer may be provided proximate an inside of the oven compartment. Further, the image acquirer may be configured to acquire image information corresponding to a cooked state of the food contained in the cooking space. Additionally, the cooking apparatus may also include a display which displays the image information acquired by the image acquirer.

Further, the display may be provided on an oven door, and the oven door may be configured to open and close the oven compartment. Additionally, a controller may be provided at a bottom case of the oven compartment to process the image information acquired by the image acquirer, and the image information may be displayed on the display in a user selected form. Further, the controller may be configured to convert image information corresponding to the state of the heat source acquired by the first image acquirer, into information corresponding to temperature distribution indicated by either one of colors or contour lines In another feature, the image acquirer may be movably provided at an inside of the oven compartment.

Further, a non-limiting method of controlling the cooking apparatus may include acquiring either simultaneously or selectively image information corresponding a heat source generated by a burner and image information corresponding to the cooked state of food contained in a cooking space of an oven, converting the image information into a user selected form; and displaying the converted image information to the user. Additionally, the method may include periodically acquiring the image information.

Additionally, a feature of the control method may include displaying the image information as an image profile of the heat source, and providing flames as the heat source.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail to the exemplary embodiments of the present invention, examples of which are illustrated in the accompanying drawings. Wherever possible, the same reference numbers will be used throughout the drawings to refer to the same or like parts.

Figure 1:
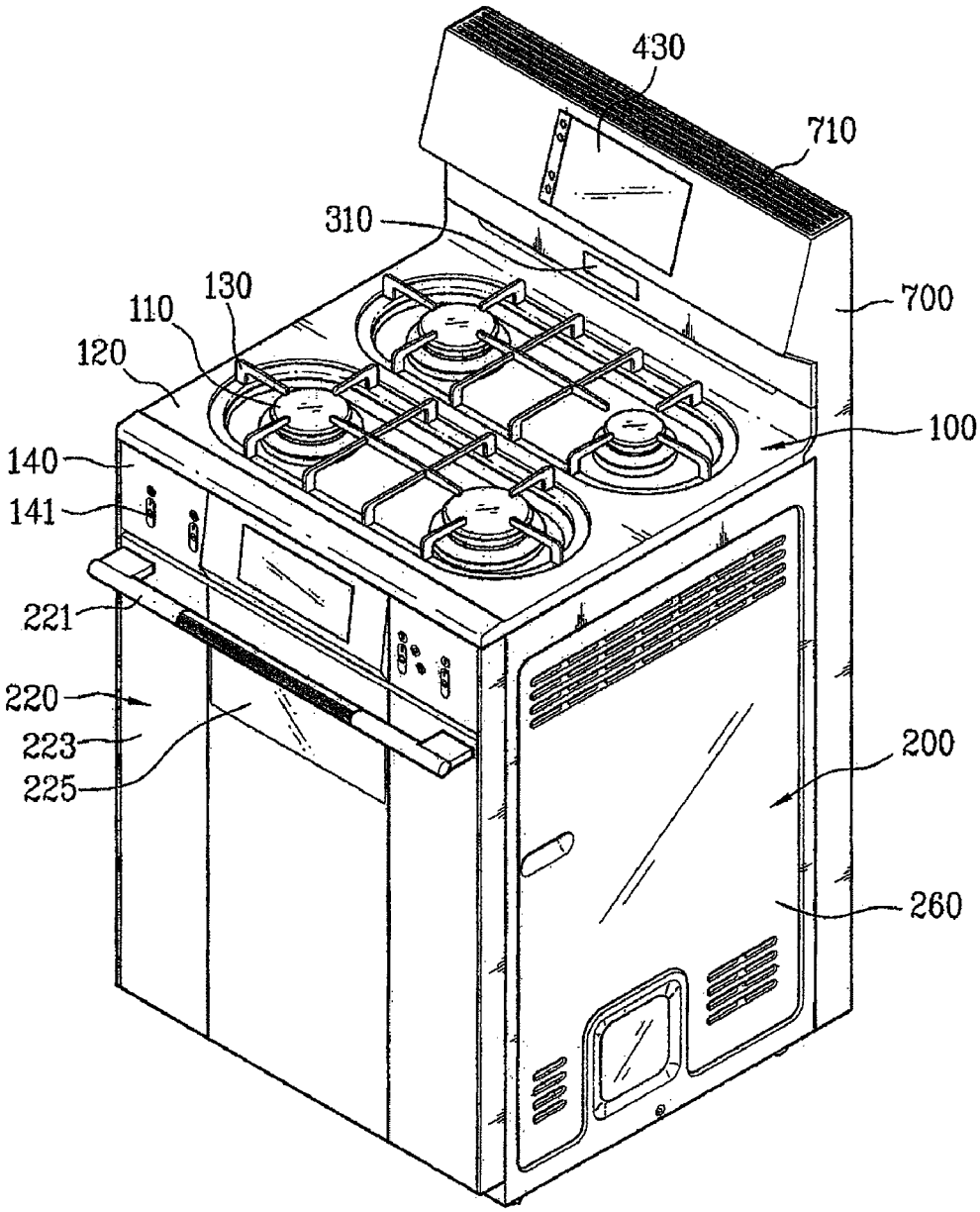
FIG. 1 is a perspective view illustrating a cooking apparatus according to a first embodiment of the present invention.
Figure 2:
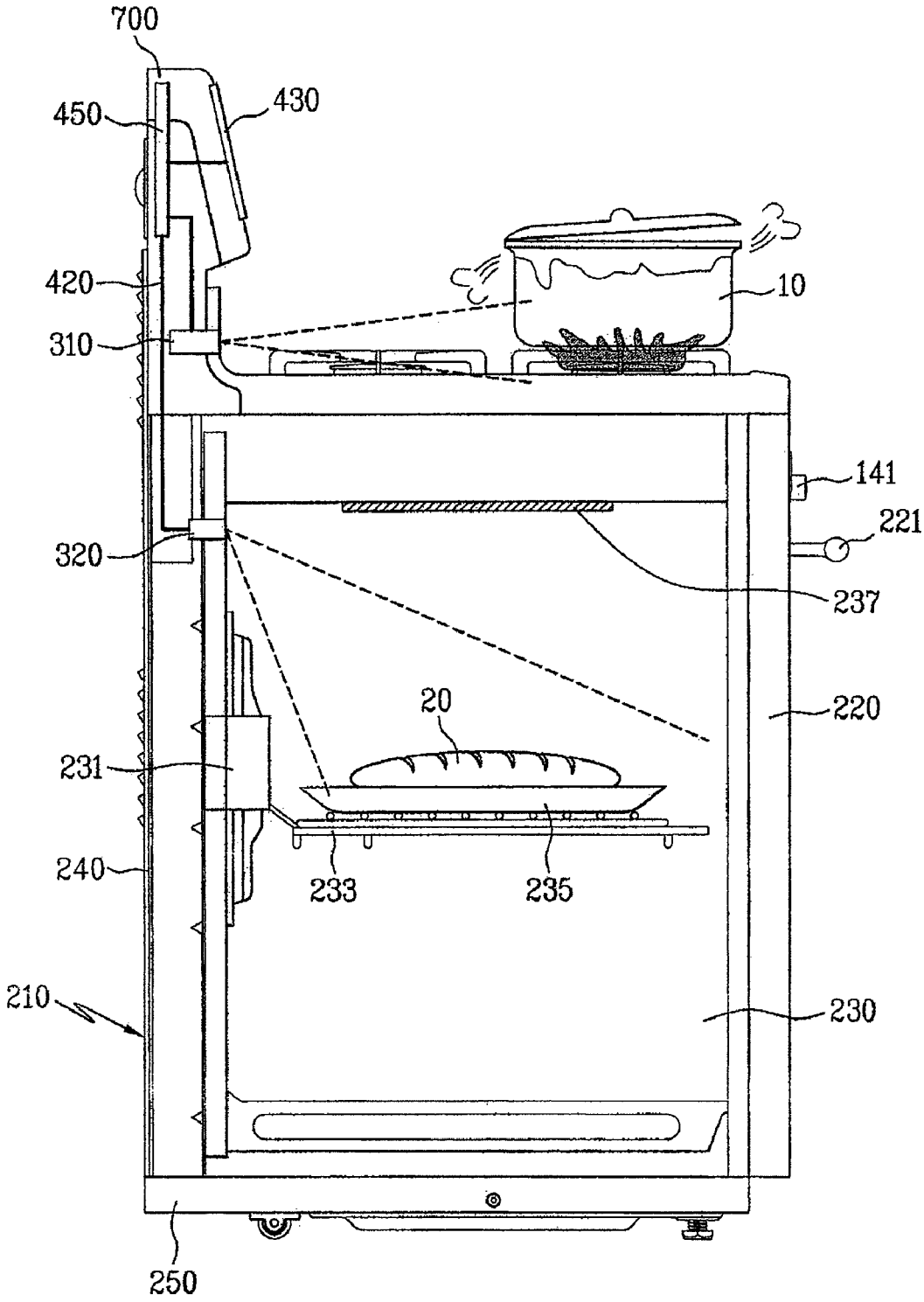
FIG. 2 is a sectional view schematically illustrating the principal components of the cooking apparatus shown in FIG. 1.

First, a cooking apparatus according to the present invention will be described in detail with reference to FIGS. 1 and 2.

The cooking apparatus may be installed in such a manner that the cooking apparatus is entirely exposed to the outside (e.g., as a free standing cooking apparatus). Alternatively, the cooking apparatus may be installed in an inside wall of a building, i.e., in a built-in structure. The cooking apparatus includes an apparatus body to cook food and a rear guide 700 formed at the apparatus body such that the rear guide 700 protrudes in an upward direction.

The apparatus body may include an oven 200 having a hermetically sealed cooking space to cook food and a burner 100 mounted above the oven 200.

The oven 200 heats food in the hermetically sealed cooking space such that the food may be cooked by dry heat. The burner 100 heats an object in an open state (e.g., an object place on a stove top). Fossil fuel, including gas, may be used as an energy source for the oven 200 and the burner 100. Alternatively, electric energy may be used as an energy source for the oven 200 and the burner 100. In this regard, one ordinary skill in the art would appreciate that any suitable energy source, which is suitable for cooking food (or heating any other contents), may be employed.

The burner 100 may an open-type burner which is mounted above the oven 200 while being exposed to the outside (i.e., the surroundings). Of course, a glass may be mounted on the top of the burner 100 such that an object to be heated is placed on the glass.

The burner 100 may include a burner housing 120 forming the external appearance of the burner 100, a burner body 110 mounted at the inside of the burner housing 120, and a gridiron 130 mounted on the top of the burner body 110.

To the burner body 110 may be connected a gas supply pipe (not shown), through which gaseous fuel may be supplied to the burner body 110, and an air supply pipe (not shown), through which air may be supplied to the burner body 110. The gaseous fuel and air supplied to the burner body 110 may be mixed and then burnt to apply heat to an object. That is, flames generated from the burner body 110 heats (or cooks) an object placed on the gridiron 130.

To the front of the burner housing 120 may be mounted control panel 140 to control the burner 100 and the oven 200. Of course, the control panel 140 may control any one of an image acquirer, a controller, or a display, which will be described below.

The oven 200 may include an oven compartment 210 having at least one cooking space 23 and at least one oven door 220 to open and close the oven body 210.

The oven compartment 210 may include a bottom case 250 forming the bottom of the oven body 210, a side case 260 forming the side of the oven body 210, and a rear case 240 forming the rear of the oven body 210.

In the oven compartment 210 there may be mounted a cooking container 235, on which food 20 to be cooked may be placed. In the oven compartment 210 there may also be mounted a tray 233, on which the cooking container 235 may be placed. The tray 233 may be supported by a support 231. In the oven compartment 210 there may also be mounted at least one heater 237 to supply heat to the food.

The heater 237 may supply heat to food using fossil fuel, including gas, or electricity. However, one of ordinary skill in the art would appreciate that any suitable energy source may be employed. The heater 237 may be mounted in the upper part of the cooking space 230 provided in the oven compartment 210. Alternatively, the heater 237 may be mounted in the lower part of the cooking space 230 provided in the oven compartment 210. According to circumstances, the heater 237 may be mounted to the inner wall of the oven compartment 210 opposite to the oven door 220. However, one of ordinary skill in the art would appreciate that the heater 237 may be provided at any position (or location) in the cooking apparatus suitable for transferring heat to an object to be heated (or cooked).

The heater 237 may include a heater housing forming the external appearance of the heater 237 and a heat generator which generates heat when energy is supplied to the heat generator from the energy source. When electric energy is supplied to the heat generator from the energy source, this electric energy may be household alternating current or direct current from a power source.

The tray 233 may be stationary in the oven body. Preferably, however, the tray 233 may be configured to automatically rotate inside of the oven compartment 210. When the tray 233 rotates during cooking food, the food is more uniformly cooked.

To this end, a drive motor (not shown) to rotate the tray 233 and a power transmission unit (not shown) to transmit the rotating force of the drive motor to the tray 233 may be mounted in the oven compartment 210.

The oven door 220 may be mounted to the front of the oven compartment 210. The oven door 220 may be hingedly connected to the bottom case 250 of the oven compartment 210 such that the oven door may be opened and closed in the forward and rearward directions. The oven door 220 may include a door grip 211 to open and close the oven door 220, a door frame 223 forming the edge of the oven door 220, and a central panel 225 mounted in the door frame 223. The central panel 225 may be made of a transparent material such that a user may look inside of the oven compartment through the central panel 225.

The rear guide 700 may be formed at the top of the rear case 240 such that rear guide 700 protrudes in an upward direction from the rear case 240. In the rear guide 700 there may be provided an exhaust gas channel 710 through which exhaust gas may be discharged from the oven 200.

Specifically, one end of the exhaust gas channel 710 may communicate with the cooking space 230, and the other end of the exhaust gas channel 710 may communicate with the outside. The rear guide 700 may be provided at the front thereof with a first image acquirer 310 to acquire image information about (or corresponding to) the state of flames (or any other suitable heat source) generated from the burner body 110. The first image acquirer 310 may be an image recognizer which recognizes the state of, e.g., flames as an image. In this regard, one of ordinary skill in the art should appreciate that the image recognizer may be configured to recognize any suitable heat source including, but not limited to, flames, electricity (e.g., a burner which generates heat by utilizing current passing through a coil), and so on.

The first image acquirer 310 may acquire image information corresponding to the state of flames between the top of the burner body 110 and an object 10 to be heated. The imaging angle of the first image acquirer 310 may be adjusted in accordance with a user's selection.

In the rear case 240 there may be mounted a second image acquirer 320 which photographs the interior of the cooking space. Specifically, the second image acquirer 320 may acquire image information corresponding to the cooked state of food which is being cooked in the oven compartment.

The second image acquirer 320 may be movably mounted in the oven compartment 210. The imaging angle of the second image acquirer 320 may also be adjusted according to a user's selection. Charge coupled device (CCD) cameras as well as general cameras may be used as the first image acquirer and the second image acquirer.

Further, the rear guide 700 may also be provided at the front thereof with a display 430 to display the image information acquired by the first and second image acquirers 310 and 320, respectively. The display 430 may include a flat panel display, including a liquid crystal display (LCD).

The display 430 may be mounted at the front of the burner housing 120 as well as the rear guide 700. Alternatively, the display 430 may be mounted at the front of the oven door 220. Additionally, a plurality of displays 430 may be provided to display a variety of information. Also, one of ordinary skill in the art would appreciate that the display 430 may be mounted at any suitable position (or locations) where the information can be conveyed to a user, e.g., by observation of the user.

Between the display 430 and the first and second image acquirers 310 and 320 there may be mounted a controller 450 to process the image information acquired by the first and second image acquirers 310 and 320.

The controller 450 may be configured to convert the image information corresponding to the state of, e.g., the flames imaged by the first image acquirer 310 and the image information corresponding to the cooked state of food imaged by the second image acquirer 320 into a form desired by the user (i.e., a user selected form).

Specifically, the controller 450 controls the image information acquired by the first and second image acquirers 310 and 320, respectively, to be directly displayed on the display 430 or the image-processed information to be displayed on the display 430. For example, the controller 450 may convert the image information corresponding to the state of flames acquired by the first image acquirer 310 into information corresponding to the temperature distribution indicated by colors or contour lines.

Also, the controller 450 may select image information desired by a user from the image information acquired by the first image acquirer 310 and the image information acquired by the second image acquirer 320 as the image information to be outputted to the display 430. For example, the controller 450 may sequentially display the image information acquired by the first and second image acquirers 310 and 320 on the display 430. Alternatively, the controller 450 may simultaneously display the image information acquired by the first and second image acquirers 310 and 320, respectively, on two divided sections of the display unit 430.

Of course, displays may be mounted such that the displays are in one-to-one correspondence with the image acquirers, whereby the pieces of image information acquired by the respective image acquiring devices are displayed on the corresponding display units.

Between the display 430, the controller 450, and the image acquirers 310 and 320, respectively, there may be mounted an information transmitter 420 which transmits the image information as an electric signal. The information transmitter 420 may be an electric wire to electrically interconnect the display 430, the controller 450, and the image acquirers 310 and 320. However, one of ordinary skill in the art would appreciate that elements, arrangement, or structure, suitable for transmitting image information, may be employed.

However, the present invention is not limited to the above-described embodiment. For example, the display 430, the controller 450, and the image acquirers 310 and 320, respectively, may transmit and receive the image information in a wireless fashion.

Hereinafter, the operation of the cooking apparatus with the above-stated construction will be described.

First, a user may place an object 10 containing food to be cooked on, e.g., a gridiron 130 such that the food may be cooked by the burner 100. Subsequently, the user may operate the burner 110 and control flames applied to the object 10 by operating a control button 141 mounted on the control panel 140.

At this time, the user operates the first image acquirer 310 and the display 430 using the control button 141 so as to check the state of flames between the object 10 and the burner body 110. Of course, the first image acquirer 310 and the display 430 may be operated simultaneously when the operation of the cooking apparatus is initiated.

The first image acquirer 310 acquires image information corresponding to the state of flames, and the acquired image information may be transmitted to the controller 450. The controller 450 may process the image information acquired by the first image acquirer 310 into a form desired by the user (i.e., a user selected form). The image information processed by the controller 450 may be displayed on the display 430.

Consequently, it is possible for the user to continuously check the image information which corresponds to the state of flames. Of course, the image information maybe periodically checked at predetermined intervals according to a user's selection.

Also, the user may operate the second image acquirer 320 using the control button 141. Of course, the second image acquirer 320 may be operated simultaneously with the first image acquirer when the operation of the cooking apparatus is initiated. In this regard, the second image acquirer 320 may acquire image information corresponding to the cooked state of the food placed in the oven compartment 210.

The image information acquired by the second image acquirer 320 may be transmitted to the controller 450, and the controller 450 may process the image information acquired by the second image acquirer 320 into a form desired by the user (i.e., a user selected form).

Also, the controller 450 may transmit the image information which the user wishes to see, between image information acquired by the first image acquirer 310 and image information acquired by the second image acquirer 320, to the display 430. The display 430 may display either simultaneously or selectively the transmitted image information.

Consequently, it is not necessary that the user bend his/her back to check the state of flames so as to check the image information about the flames between the object 10 and the burner body 110. Also, it is not necessary that the user open the oven door to check the cooked state of the food placed in the oven body.

Consequently, the present invention has advantages in that it is possible to accurately check the cooked state of the food in the oven body without opening the oven door and that it is possible to reduce the loss of energy due to the frequent opening and closing of the oven door.

Of course, the cooking apparatus may include either an oven or a burner. For example, when the cooking apparatus includes only the burner, the cooking apparatus includes an apparatus body to cook food and a burner body mounted above the apparatus body. Also, the cooking apparatus may include an image acquirer to acquire image information corresponding to the state of flames generated by the burner body and a display to display the information acquired by the image acquirer.

Specifically, the image acquirer may acquire image information corresponding to the state of flames between an object to be heated and the apparatus body. Also, the display may be mounted at a rear guide formed at the rear of the apparatus body such that the rear guide protrudes in an upward direction, a burner housing of the burner body, and/or a door to open and close the apparatus body.

Figure 3:
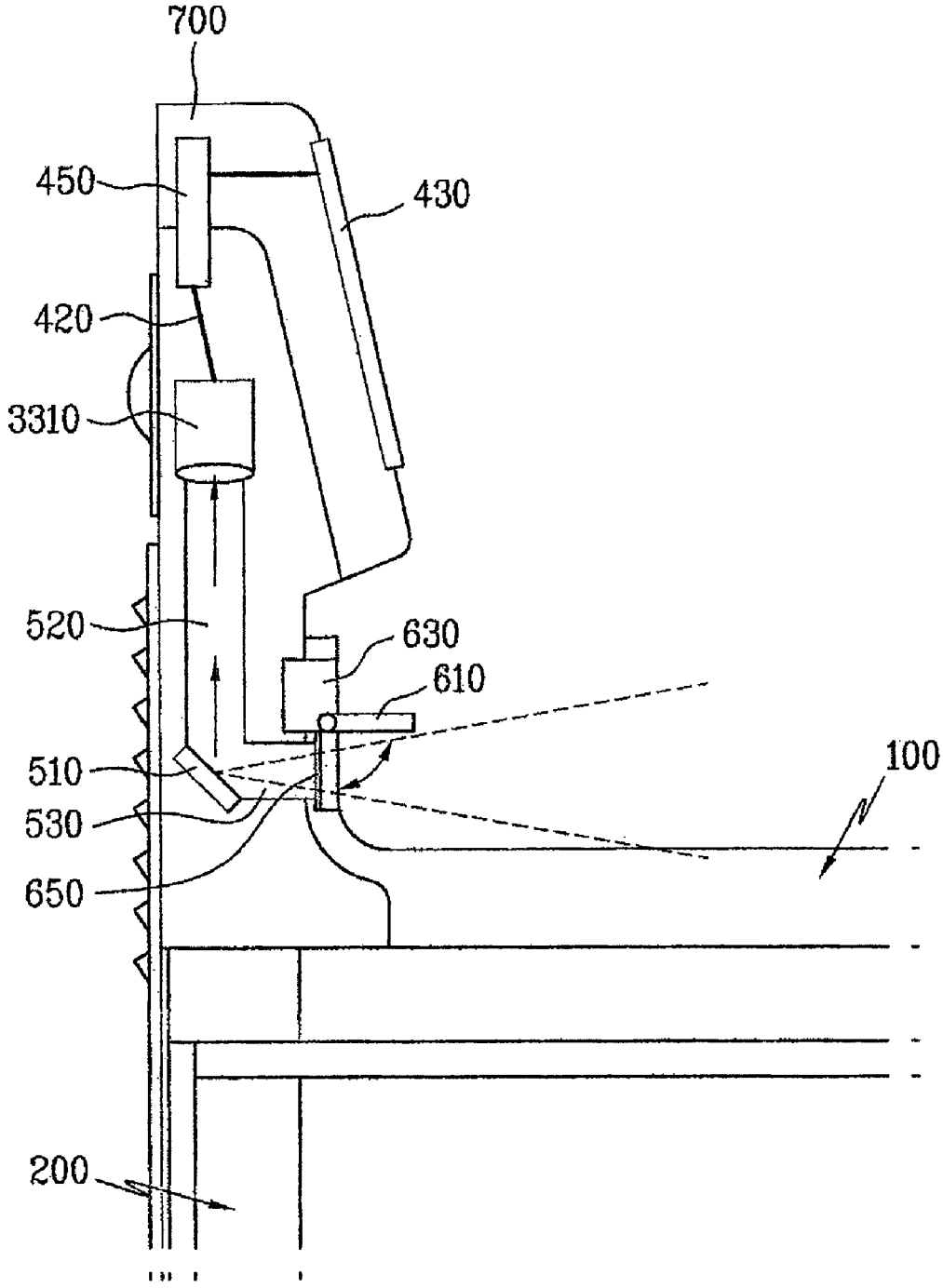
FIG. 3 is a sectional view schematically illustrating the principal components of a cooking apparatus according to a second embodiment of the present invention.

Hereinafter, a cooking apparatus according to a second embodiment of the present invention will be described with reference to FIG. 3. Like the previously described first embodiment, the cooking apparatus according to the second embodiment includes an oven unit 200 and a burner unit 100. The cooking apparatus according to the second embodiment further includes a protector which protects an image acquirer 3310.

Also, the cooling apparatus may include ducts and a reflector 510 mounted between the ducts which are provided to reduce thermal energy transmitted to the image acquirer 3310.

The protector may include a protection cover 610 to primarily block the transmission of heat to the image acquirer 3310 and to prevent the image acquirer 3310 from being contaminated and a driver configured 630 to open and close the protection cover 610.

The protection cover 610 may open the image acquirer 3310, when the image acquirer 3310 is operated, and may close the image a 3310, when the image acquirer 3310 is not operated. The protection cover 610 may also have low thermal conductivity and high heat resistance. Also, the driver 630 may be mounted at one side of the protection cover 610 to open and close the protection cover 610. The driver 630 may also include a general direct current (DC) motor or a brushless direct current (BLDC) motor. The driver 630 may be controlled by a control panel of the cooking apparatus.

At least one reflector 510 may be mounted proximate the cooking apparatus such that image information corresponding to an object placed such that the object is not opposite to (i.e., facing) the image acquirer 3310, can be recognized by the image acquirer 3310.

Specifically, the reflector 510 may be mounted between the image acquirer 3310 and the object. For example, when flames between the burner body and the object are to be photographed, the reflector 510 may be mounted at a side opposite to the flames (i.e., an oppositely facing side), and the image acquirer 3310 may be mounted at a position where the image acquirer 3310 may photograph images of the flames reflected by the reflector 510.

In the rear guide 700 there may be mounted a first duct 520 having a predetermined length and a second duct 530 connected to the first duct 520 at a predetermined angle. The image acquirer 3310 may be mounted at one end of the first duct 520, and the other end of the first duct 520 may be connected to the second duct 530. The reflector 510 may be mounted at the connection between the first duct 520 and the second duct 530.

Consequently, the reflector 510 may reflect an image of the flames, and the reflected image of the flames may be transmitted to the image acquirer 3310. As a result, only a small amount of thermal energy generated from the flames may be transmitted to the image acquirer 3310, which is relatively distant from the flames.

Also, the second duct 530 may be opposite (i.e., oppositely facing) to flames to be photographed by the image acquirer 3310. At the end of the second duct 530 opposite to the flames there may be mounted a transparent window 650 which blocks the direct transmission of heat to the image acquirer 3310. The transparent window 650 may always be closed irrespective of when the flames are photographed by the image acquirer 3310. Consequently, the transparent window 650 blocks the transmission of heat to the image acquirer 3310 together with the protection cover 610. Additionally, the transparent window 650 may be made of a material having high heat resistance and relatively low thermal conductivity.

The first duct 520 and the second duct 530 may be constructed (or provided) as a linear structure. However, the first duct 520 and the second duct 530 may be provided in a bent structure in which the first duct 520 and the second duct 530 are bent several times at a predetermined angle. In this case, the reflector which reflects images may be mounted at the bent regions of the first duct 520 and the second duct 530 such that the image acquirer 3310 can acquire images of an object.

In this embodiment, a mirror is used as the reflector 510. However, one of ordinary skull in the art would appreciate that the reflector 510 is not limited to the mirror, and any element, structure, or arrangement, suitable for reflecting the image may be used as the reflector 510. Also, the structure to reduce thermal energy transmitted to the image acquirer 3310 may be applied to acquire the image information corresponding to the cooked state of the food which is being cooked in the oven compartment, as well as acquiring the image information corresponding to the state of flames between the burner body and the object. In this case, the reflector and the ducts may be mounted at the rear case and/or the rear guide.

Figure 4:
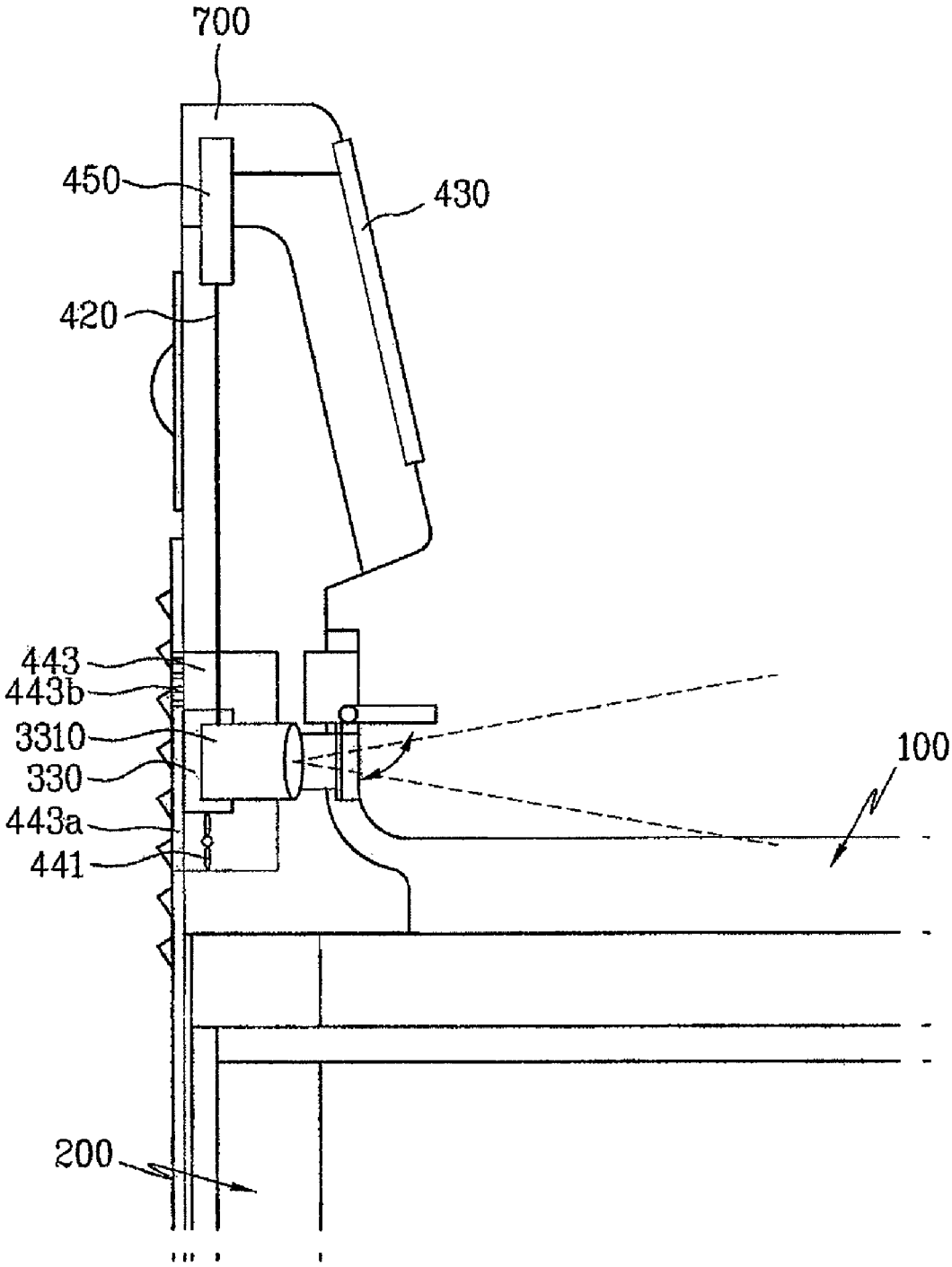
FIG. 4 is a sectional view schematically illustrating the principal components of a cooking apparatus according to a third embodiment of the present invention.

Hereinafter, a cooking apparatus according to a third embodiment of the present invention will be described with reference to FIG. 4. Like the previously described embodiments, the cooking apparatus according to the third embodiment includes an oven 200 and a burner 100. Also, the cooking apparatus according to the third embodiment includes a rear guide 700, a display 430, a controller, an information transmitter 420, a protection cover 610, a driver 630, and a transparent window 650, which are identical to those of the cooking apparatuses according to the previously described embodiments, and therefore, a detailed description thereof will not be given.

Further, the cooking apparatus according to the third embodiment may include a cooler which cools an image acquirer 3310. The cooler may serve to prevent the image acquirer 3310 from being damaged due to thermal energy transmitted to the image acquirer 3310 (i.e., caused by heat produced by the cooking apparatus).

The cooler may include a cooling duct 443 which communicates with a space in which the image acquirer 3310 may be mounted and a cooling fan 441 mounted at one side of the cooling duct 443. The cooling duct 443 may surround an image acquirer installation part 330 in which the image acquirer 3310 may be mounted. The cooling duct 443 may have an inlet port 443*a* and an outlet port 443*b*, which communicate with the outside.

The cooling fan 441 may forcibly suction air from the inlet port 443*a* of the cooling duct 443 and discharge the air to the outlet port 443*b* of the cooling duct 443. A portion of the image acquirer 3310 may be exposed in a space provided by the cooling duct 443, and therefore, the image acquirer 3310 may be cooled by air flowing along the cooling duct 443. The operation of the cooler may be manually or automatically controlled. For example, a temperature sensor which measures the temperature of the image acquirer 3310 may be mounted at either one of the inside or outside of the image acquirer 3310. The temperature sensor may be connected to a controller of the cooking apparatus. The controller of the cooking apparatus may control the operation of the cooler depending upon the temperature measured by the temperature sensor.

Figure 5:
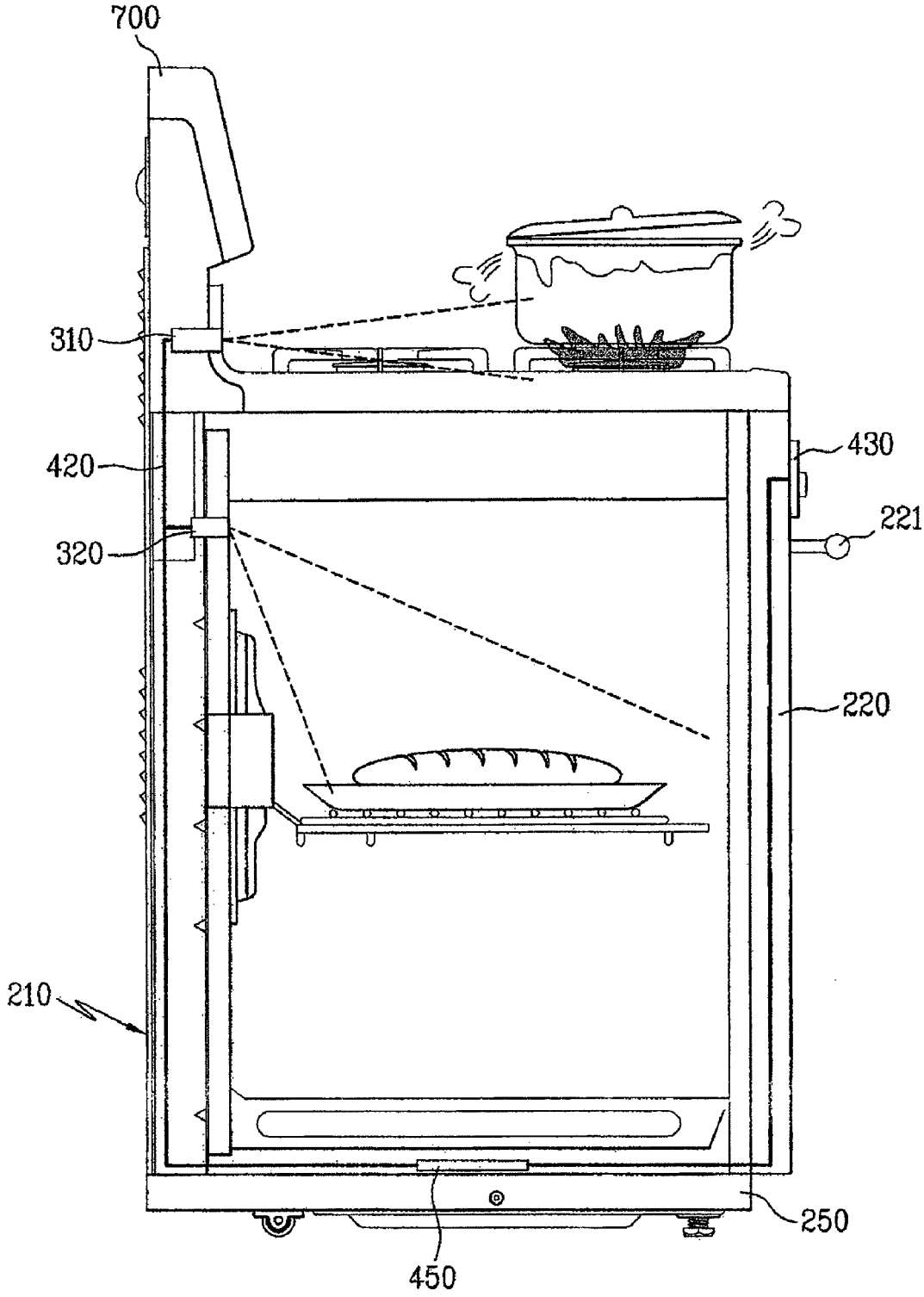
FIG. 5 is a sectional view schematically illustrating the principal components of a cooking apparatus according to a fourth embodiment of the present invention.

Hereinafter, a cooking apparatus according to a fourth embodiment of the present invention will be described with reference to FIG. 5. Like the previously described embodiments, the cooking apparatus according to the fourth embodiment may include an oven 200, which has an oven compartment 210 and an oven door 220, and a burner 100 mounted above the oven. Also, the cooking apparatus according to the fourth embodiment may include a first image acquirer 310 which acquires image information corresponding to the state of flames generated from a burner body of the burner 100 and a second image acquirer 320 which acquires image information corresponding to the cooked state of food which may be being cooked in the oven 200.

Further, the cooking apparatus according to the fourth embodiment may include a display 430, mounted at the oven door 200, to display image information desired by a user (i.e., user selected information). Also, the cooking apparatus according to the fourth embodiment may include a controller 450 mounted at a bottom case 250 of the oven 200 to process the image information acquired by the first and second image acquirers 310 and 320, respectively, into a form desired by the user (i.e., a user selected form).

Consequently, an information transmitter 420 to interconnect the first and second image acquirers 310 and 320, respectively, and the controller 450 and to interconnect the controller 450 and the display 430 may be mounted in such a manner that the information transmitter 420 surrounds the lower part of the oven compartment 210. The information transmitter 420 may be connected between the bottom case 250 and the oven door 220 to interconnect the controller 450 and the display 430. The information transmitter 420 may be mounted at a hinge structure to interconnect the bottom case 250 and the oven door 220.

Of course, the display 430 may be mounted at the front of a burner housing, and the controller may be mounted in a rear case. In this case, the information transmitter 420 which interconnects the display 430 and the controller 450 may be mounted inside of the burner housing.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As apparent from the above description, the present invention has the following effects.

First, the image information about the state of flames generated from the burner body may be checked on the display mounted on the outside of the apparatus body. Consequently, it is possible for a user to easily check the state of the flames and to conveniently control the amount of heat applied to an object to be heated.

Second, the cooked state of food which is being cooked in the cooking space provided in the apparatus body may be checked without opening the door. Consequently, it is possible to reduce the loss of energy which may be caused by the opening of the door.

Third, the cameras included in the image acquirers to photograph or image the state of flames and the cooked state of food may be protected by the protection cover, which may be operated by the driver. Consequently, it is possible to safely protect the image acquirers.

Fourth, image information corresponding to objects placed not being opposite to the image acquirers may be recognized by the image acquirers through the use of the reflectors. Consequently, it is possible to reduce the amount of thermal energy transmitted to the image acquirers.

Fifth, the amount of thermal energy transmitted to the image acquirers may be reduced by the provision of the cooling duct and the cooling fan mounted in the cooling duct. Consequently, it is possible to prevent the image acquirers from being damaged due to heat.

What is claimed is:

1. A cooking apparatus comprising:

an apparatus body having a burner which heats an object;

a first image acquirer provided at one side of the apparatus body, wherein the first image acquirer is configured to acquire image information corresponding to flames generated by the burner;

a display provided at one side of the apparatus body to display the image information acquired by the first image acquirer;

an oven having a cooking space to cook food, wherein the oven is mounted below the burner;

a second image acquirer configured to acquire image information corresponding to a cooked state of the food contained in the cooking space;

a protection cover which protects either one of the first image acquirer and the second image acquirer; and a driver configured to open and close the protection cover.

2. The cooking apparatus according to claim 1, wherein the first image acquirer is configured to acquire the image information corresponding to a state of the flames provided between the object and the burner.

3. The cooking apparatus according to claim 1, wherein the display is provided on at least one of a rear guide provided at the rear of the apparatus body and protruding upwardly therefrom, a burner housing which houses the burner, and a door which opens and closes a cooking chamber of the apparatus body.

4. The cooking apparatus according to claim 1, wherein the display selectively displays the image information acquired by the first image acquirer and the second image acquirer.

5. The cooking apparatus according to claim 1, further comprising a controller to process the image information acquired by either one of the first image acquirer and the second image acquirer, wherein the image information is displayed on the display in a user selected form.

6. The cooking apparatus according to claim 1, further comprising at least one reflector provided between either one of the first and second image acquirers and the object, wherein the at least one reflector is configured to transmit information about either one of the flames and the food contained in the cooking space to either one of the first and second image acquirers.

7. The cooking apparatus according to claim 6, further comprising:

a first duct having either one of the first and second image acquirers provided at a first end thereof and the reflector provided at a second end thereof; and a second duct having a first end connected to the first duct at a predetermined angle and a second end facing the object.

8. The cooking apparatus according to claim 7, further comprising a transparent window provided at the second end of the second duct, wherein the transparent window blocks the direct transmission of heat to the either one of the first and second image acquirers.

9. The cooking apparatus according to claim 1, further comprising a cooler which prevents either one of the first and second image acquirers from being damaged due to heat of the cooking apparatus.

10. The cooking apparatus according to claim 9, wherein the cooler comprises a cooling duct communicating with a space in which either one of the image acquirers are provided, and a cooling fan provided at a first side of the cooling duct.

11. A cooking apparatus comprising:

an oven compartment having a cooking space to cook food contained therein;

an image acquirer provided proximate an inside of the oven compartment, wherein the image acquirer is configured to acquire image information corresponding to a cooked state of the food contained in the cooking space;

a display which displays the image information acquired by the image acquirer;

a protection cover which protects the image acquirer; and a driver configured to open and close the protection cover.

12. The cooking apparatus according to claim 11, wherein the display is provided on an oven door, the oven door being configured to open and close the oven compartment.

13. The cooking apparatus according to claim 12, further comprising a controller provided at a bottom case of the oven compartment to process the image information acquired by the image acquirer, wherein the image information is displayed on the display in a user selected form.

14. The cooking apparatus according to claim 11, wherein the image acquirer is movably provided at an inside of the oven compartment.

15. The cooking apparatus according to claim 13, further comprising an information transmitter which interconnects the image acquirer, the controller, and the display, wherein the information transmitter is provided to surround at least a portion of the oven compartment.

* * * * *